United States Patent [19]

Gough

[11] 4,157,755

[45] Jun. 12, 1979

[54] TOP LOADING COMPARTMENTED BEVERAGE CARTON

[75] Inventor: Michael R. Gough, London, Canada

[73] Assignee: Labatt Breweries of Canada Limited, London, Canada

[21] Appl. No.: 861,211

[22] Filed: Dec. 16, 1977

Related U.S. Application Data

[63] Continuation-in-part of Ser. No. 722,544, Sep. 13, 1976, abandoned.

[51] Int. Cl.[2] ..... B65D 75/52

[52] U.S. Cl. ..... 206/193; 206/140; 229/15; 229/27; 229/52 BC

[58] Field of Search ..... 229/15, 23 R, 27, 28 R, 229/28 BC, 52 B, 52 BC; 206/140, 193

[56] References Cited

U.S. PATENT DOCUMENTS

| | | | |
|---|---|---|---|
| 2,284,385 | 5/1942 | Freshwaters | 229/52 B |
| 2,481,871 | 9/1949 | Potts | 229/52 B |
| 2,710,135 | 6/1955 | Gaylord | 229/52 B |
| 3,464,619 | 9/1969 | Nordstrom | 229/52 B |
| 3,533,549 | 10/1970 | Gilchrist | 229/52 B |

*Primary Examiner*—Herbert F. Ross

*Attorney, Agent, or Firm*—Fisher, Christen & Sabol

[57] ABSTRACT

A top loading rectangular carton, which does not have the disadvantages of the known cartons. The carton is inexpensive and has good rigidity and strength. The carton is made of foldable sheet material and includes a carton shell and an article divider unit. The shell has opposed pairs of sidewall and endwall panels in foldably connection relationship. The top and bottom edges of the respective wall panels are provided with top and bottom closure flaps in foldably connection relationship thereto. One sidewall panel has in an upper central region thereof a hand hole for lifting the carton. The hand hole is closable by a flap hinged to the sidewall portion bordering the upper boundary of the hand hole. The divider unit includes two divider end panels. One of the end panels is secured to the interior surface of each sidewall panel and joined by a center panel extending laterally across the carton, parallel to the carton endwall panels, to tie the sidewall panels together. The other end panel has an elongated reinforcing portion secured to and extending over a major portion of the sidewall area between a line defined by the upper edge of the carton sidewall and a line parallel thereto and including the upper boundary of the hand hole. There is a generally trapezium-shaped tab which has two sides, a longer and upper edge and a shorter and lower edge - the edges are generally parallel to each other. The tab is hingedly affixed along the upper edge via a hinge line to the central portion of the elongate reinforcing portion. Each of the sides extends from the lower tab edge to a point short of the hinge line. The tab overlaps the entire length of the hand hole flap and has a length at least 1½ times the length of the flap and a width at least one-third that of the flap. In the carrying condition the tab and flap coact to provide a corrugation of material of double thickness for the hand.

11 Claims, 10 Drawing Figures

TOP LOADING COMPARTMENTED BEVERAGE CARTON

This is a continuation-in-part of application Ser. No. 722,544, filed Sept. 13, 1976, now abandoned.

BACKGROUND OF THE INVENTION

1. Field of the Invention

This invention relates to an improvement in carrying cartons and more particularly to a top loading rectangular carton having a hand hold in a sidewall.

2. Description of the Prior Art

Many different types of cartons have been designed for carrying bottled beverages such as beer. The main objective is to produce a carton which is inexpensive but which has relatively large rigidity and strength. Moreover, the present trend, reinforced in many states by law, is toward returnable bottles and consequently, the carton must also serve as a retripper when filled with the empty bottles. This requirement places an additional severe restriction on the carton design since many prior art cartons rely on a complete rigid structure provided by a permanently affixed top cover comprising a secured flap system to provide the necessary strength. Once such cartons have been opened to gain access to the contents, the flaps cannot be resealed and, hence, the carton's rigidity is irretrievably lost. Many prior art cartons of this type are also provided with hand holes in an end or sidewall. In many instances, these hand holes are so formed that they are in the nature of "punch-ins" hinged along the top edge. This simple construction provides some advantages but also has several inherent weaknesses, in particular, there is a great tendency for the sidewall to rip or tear when being carried, the rip or tear generally being initiated at the tear usually at an upper corner thereof. This tendency is increased if, as in many instances, the container wall containing the hand hole is able to "bow" when the container is being carried. Reinforcement of the container wall by providing added thickness has been suggested to overcome this problem. In some known containers, when added strength was required a prohibitably expensive, thick paper board was used in the construction of the carton or an additional layer of paperboard was glued or stapled to the inside of the container wall adjacent the hand hole. However, this method is, again, expensive, not only increasing the cost of the carton but also necessitating additional assembling operations. A carton of this type is described in U.S. Pat. No. 2,710,135 to Gaylord, where a narrow reinforcing strip of material is permanently secured to the container wall above the hand hole. However, this carton has several major practical disadvantages including the difficulty of locating, aligning and securing the reinforcing strip in position on the wall. In fact, it would most probably be impossible to effect such an operation at the speed necessary to make such a carton economically under modern conditions. In addition, the end wall in such a carton would bow outwardly when being carried and the integrity of the V-shaped reinforcement could not be maintained and a simple doubling of the carton wall results, a much less rigid and strong arrangement. In view of the known disadvantages of affixing reinforcement to the carton wall container the hand hole, attempts have been made to provide the required reinforcement by having a loose (unsecured) insert inside the carton, a portion of which lies adjacent the hand hole. Such a carton is disclosed in U.S. Pat. No. 2,284,385 to Freshwaters. Freshwaters' carton includes an end section which lies against the endwall containing the hand hole. The end section has a hole which coincides with the punched-in hand hole in the carton endwall, the hinged flap of the punch-in hand hole being arranged to extend through the coincident hole in the end section and turn upward. A major feature of the invention is that the instruck flap abutts the undersurface of the top wall of the carton so that lifting force places the portion of the reinforcing end section between the hand hole and the undersurface of the top wall in compression and transmits the lifting force to the carton top wall, this allegedly distributing the lifting force more uniformly. However, this carton also has some significant disadvantages; the carton top wall is, of course, formed by flaps which are unsealed to extract the carton contents and are not resealable. Hence, once opened no reinforcing effect is provided and a drastically weakened carton results unsuitable for retripper use. Moreover, this carton utilizes a very complex and expensive insert which does not assist in preventing undesirable bowing of sidewalls or increasing the inherent rigidity of the carton since as is clear from the teaching of the patent, the insert is not secured to the carton walls (the avoidance of such a securing step is a major objective of the invention mainly because, in known cartons, such a step is expensive and time consuming). In fact, with the complex bottle divider unit utilized in this carton, it would be extremely difficult if not impossible to provide for a securing step at any speed whatsoever and definitely not at the speeds dictated by modern conditions and, hence, for both reasons, securing the insert to the container sidewalls would not only not be considered as a possibility but is actually indicated as being undesirable if the advantages taught by that patent are to be achieved. Two further cartons which utilize instruck punched-in flaps are disclosed in U.S. Pat. Nos. 2,310,408 to Ehrenfeld and 3,553,549 to Gilchrist. The former uses, as does Freshwaters above, a non-secured insert but in Freshwaters case this is in two parts, hence, requiring additional manufacturing and assembling steps. The insert can also have an "instruck" flap which forms a double wall with the sidewall, the double wall not being a lamination since the components are not secured together. Hence, although a small increase in strength may be achieved by this arrangement, there is little reduction in the tendency of the carton wall to tear and once opened, the additional strength is effectively lost. Moreover, as stated, the two-piece insert is a luxury a mass-produced give-away carton cannot afford. The latter patent to Gilchrist discloses an end-loading carton which may be used as a retripper since the rigidity and strength imparted by a secured top cover is not totally lost when the carton is opened because of the provision of an opening section having an area less than that of the carton top. Upon the panel opening, a reinforcing rim is left around the top of the carton end and sidewalls. The instruck flap must, of necessity, extend to and contact the underside of the container top. This, again, gives an unsecured simple double/triple wall effect as discussed previously. To obtain the full benefit of increased strength, it is necessary for the carrier to physically maintain the instruck flap hard against its associated front wall and the container top undersurface (as in Freshwaters). This, in fact, is extremely tiring and in practice cannot be maintained for any length of time. Moroever, it is not possible to have an insert in such a carton and bowing of the hand hole-containing wall with its attended disadvantages can readily occur. It may be noted that, purely for aesthetic reasons, the flap of this container has curved or angled sides which extend at least to and indeed beyond the flap's hinge line.

In view of the many disadvantages associated with such cartons having a simple hand hole, cartons have been developed which include an extensible handle member which is normally recessed within the walls of the carton during storage and shipping but is extendible to a carrying position. However, these cartons tend to be of a rather complex structure and require the use of extensive amounts of material both of which make the overall package relativly expensive. Notwithstanding the cost factor, in some cases, for example, Ontario in Canada, this package has atained extensive use because of its ease of handling etc.

It can be seen from the above, that there is a great need for an inexpensive drop-load carton for beverage containers which will meet the following:

(i) Can be made of relatively inexpensive board material whilst still providing the necessary strength and rigidity both when sealed and in an opened condition;

(ii) Can be rapidly manufactured and assembled when required; and (iii) Has adequate and convenient handle means which will not cause a tear or rupture while the carton is being used.

STATEMENT OF INVENTION

It is an object of the present invention to provide a simple and inexpensive top-loading two-cell carton formed from a blank and a separate divider unit, the resulting carton having greatly increased strength in the region of the hand hole. The carton may also be manufactured at high speed using standard equipment since the divider unit is designed to provide the desired reinforcement without the need for exact locating on the carton blank during manufacture.

The present invention provides a top loading rectangular carton made of foldable sheet material, said carton comprising a carton shell and an article divider unit, the shell comprising in foldably connected relationship opposed pairs of sidewall and endwall panels, the top and bottom edges of the respective wall panels being provided with top and bottom closure flaps in foldably connected relationship thereto, one sidewall panel having in an upper central region thereof a hand hole for lifting the carton, the hand hole being closable by a flap hinged to the sidewall portion bordering the upper boundary of the hand hole, the divider unit comprising two divider end panels, one secured to the interior surface of each sidewall panel and joined by a center panel extending laterally across the carton, parallel to the carton endwall panels, to tie the sidewall panels together, one end panel having an elongate reinforcing portion secured to and extending over a major portion of the sidewall area between a line defined by the upper edge of the carton sidewall and a line parallel thereto and including the upper boundary of the hand hole, a generally trapezium-shaped tab having a longer and upper edge and a shorter and lower edge which edges are generally parallel to each other, and two sides, said tab being hingedly affixed along the upper edge via a hinge line to the central portion of the elongate reinforcing portion, each of said sides extending from the lower tab edge to a point short of said hinge line, said tab overlapping the whole length of the hand hole flap and having a length at least one and a half times the length of the flap and a width at least one third that of the flap, such that in a carrying condition the tab and flap coact to form one limb and a base of a corrugation, another limb of which is comprised of said reinforcing portion and the sidewall to which it is secured.

The term "trapezium shape" in this specification means a quadrilateral wherein a pair of sides termed "edges" are roughly parallel and of unequal length and the remaining two sides are each located at an angle to the said edges such that the shorter edge is always subtended by the longer edge. It is preferred that the two sides, which may be curved or straight, are of substantially equal length and the resulting trapezium shape is symmetrical, i.e. "regular".

The hinge joining the tab to its associated divider panel is usually a multiple, i.e. at least a double, score line and this, in combination with the fact that the slot or hole in the panel is also at least one half times, and generally at least twice, the length of the hand hole, means that exact location of the divider panel is unnecessary, there being relatively large room for errors in the longitudinal as well as lateral placement of the end panel while still retaining the hand hole completely free and unhindered.

The hinge lines of both tab and flap are adjacent, with the tab hinge being uppermost and upon a hand being inserted through the hand hole, both tab and flap combine to present a double thickness of material to the hand. The practical effect of this double hinge arrangement is that the load exerted on the sidewall by the carton contents is distributed along a larger area of double thickness sidewall and there is far less tendency for the sidewall, especially in the immediate vicinity of the hand hole to tear. It is preferred that the tab has a length of more than twice the length of the hand hole flap and that the elongate panel reinforcing portion extends over at least the middle two thirds, preferably over 70%, and especially substantially all of the length of the associated carton sidewall.

The width of the tab is important. It must be of a width so that it does function as a flap and, as stated above, effectively presents a ridge to the hand, thereby having the strength and rigidity characteristic of a corrugation as distinct from merely presenting an edge of the material to support the load. It is the provision of a ridge of longer length which allows the burden of the load to be carried by substantially the full wall and not just a small portion thereof.

As has been mentioned previously, prior art cartons which do provide an edge in the form of say a laminated sidewall, tend to be ineffective as the sidewall bends or bows: the corrugation or ridge construction of the present invention gives increased structural rigidity and strength which the prior art cartons are generally incapable of providing.

Also, as will be appreciated, the inward deflection of the flap is usually relied upon to effect the required bending of the flap about its associated hinge lines, which action produces the required corrugation. However, if the tab width is less than about one third the flap width, when the latter is deflected inwardly, there will be a tendency for the flap to bend, not as desired at its associated hinge line, but at a position nearer the flap edge, and usually beyond the extremity of the tab. This could result in the flap bending around the tab which may then be deflected a small amount, if at all, and the required ridge or corrugation may not be formed. Moreover, buckling of the flap in this manner presents a handle portion to the user to grip which is both uncomfortable and does not impart confidence when the carton is being carried. The width of the tab is preferably from about one to about two thirds that of the flap. In an especially preferred embodiment the width of the tab is about half that of the flap.

A major feature of the present invention is the provision of tab sidewalls which do not meet with the tab hinge line. In prior art cartons the cuts which defined a flap or tab extended at least to its associated hinge line and, in many instances, beyond the hinge line. Consequently when the tab or flap is instruck, generally to lie against the inside surface of the carton wall, the flap or tab sidewalls terminate directly on the hinge line and provide an obvious initiation point for a tear or rip to commence. The tongue or the like of board material purposely left between the tab hinge line and the termination of the side line of the tab is able to distort by rotating about its longitudinal axis and preventing the forming of a sharp V at the upper extremity of the tab junction with its hinge line. This effect is greatly increased when the said sides are concave in configuration and have a final portion parallel to, but spaced from, the tab hinge line, a similar effect being obtained when straight sides are provided with an additional slot extending from the extremity of each sidewall parallel to the tab hinge line. It is especially advantageous to have the said parallel extending portion of the sidewall coextensive with the length of the tab hinge. In an especially preferred embodiment the free and shorter edge of the tab is strictly parallel to the tab hinge line but is comprised of two equal concave recesses, the two outer points and the central point of the adjacent recesses falling along a straight line which is parallel to the tab hinge line.

In the context of this specification, the area between the tab sides and the tab hinge line is obviously considered part of the tab and said area, for the sake of convenience, may herein be referred to as a tongue section.

The present invention will be further described with reference to the accompanying drawings in which:

FIG. 1*a* is a plan view of an article divider unit included in the carton of the present invention;

FIG. 1*b* is a modified version of the unit shown in FIG. 1*a;*

Figure 1B:
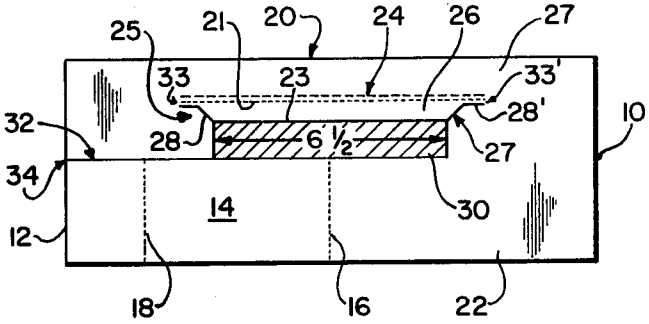
Figure 1A:
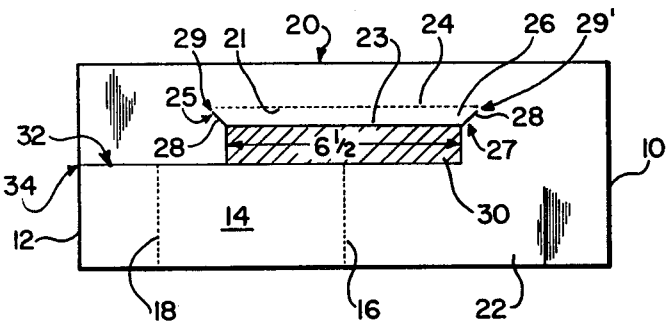
Figure 2:
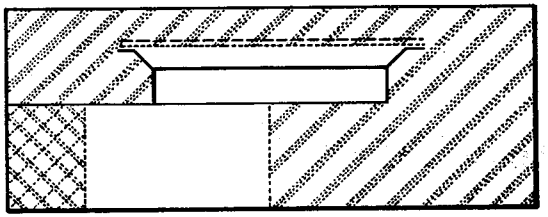
FIG. 2 is the divider unit shown in FIG. 1*b* showing the glue pattern.
Figure 4:
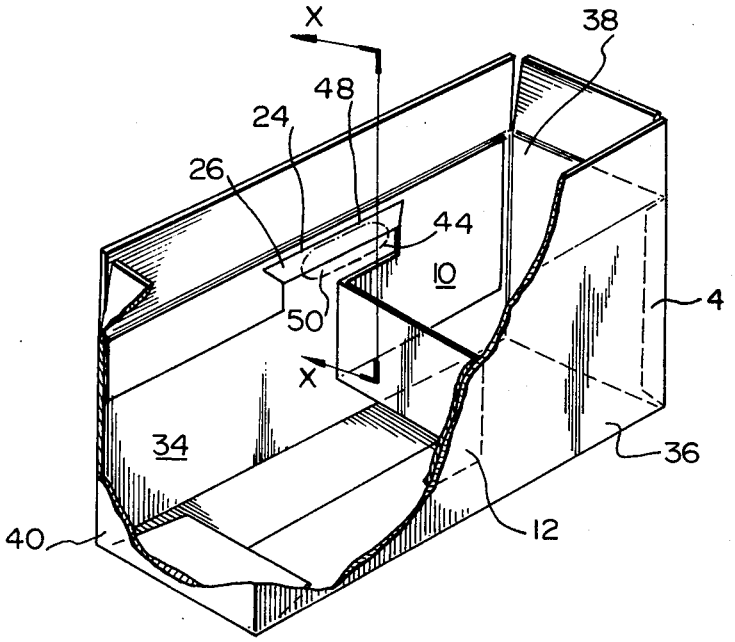
FIG. 4 is a cut-away perspective view of a carton according to the present invention.

Turning to FIGS. 1*a*, 1*b* and 2, these are plan views of divider units which may be included in the carton of the present invention. The divider unit is stamped from one piece of corrugated board. The unit comprises two end panels generally designated 10 and 12 joined by a center unit 14. The end panels are joined to the center unit by way of score hinge lines 16 and 18. End panel 10 comprises an elongated upper portion 20 which, as can be seen in FIG. 4, has a length substantially equal to the length of the carton sidewall, and a lower portion 22 integral with portion 20 having a length half that of portion 20 and arranged to extend only to the center of the carton sidewall from the join thereof with an endwall. Center panel 14 is affixed to lower portion 22 by way of hinge line 16. Affixed to the lower edge of the center portion of member 20 by way of hinge line 24 is a tab 26. In FIG. 1*a*, hinge line 24 is a single score and in FIG. 1*b* a multiple, actually double, score. The tab is of regular trapezium form, i.e. has a pair of opposing edges 21 and 23 parallel and the sides 25 and 27 mutually divergent from the lateral central axis of the tab. Lines 28 and 28' represent cuts which effectively define tab sides 25 and 27 referred to previously. Tab 26 has a length at least one and a half times, but generally twice, the length of the hand hole 44 in the corresponding carton shell (see later) and a width half that of the said hand hole (refer FIG. 5). It should be noted that lines 28 and 28' representing cuts do not extend to hinge line 24: there is a definite and significant portion of uncut board material 29 and 29' left in place.

Extending between tab 26 and panel portions 22 and 14 is a rectangular slot 30 which, as will be seen later, is somewhat larger than the hand hole in the corresponding carton shell sidewall 34.

While panel portions 20 and 12 are separate, 32 representing a cut, it is convenient to leave the two portions affixed at point 34 either by incomplete formation of cut 32 or by separately lightly tacking. This allows the divider unit to be readily handled, the distinct onepiece unit having no portion or member which can buckle or otherwise stand out from the main plane of the unit during further processing such as glueing etc. It will be noted that hinge line 24 in FIG. 1*b* is constituted by a double score extending over one eighth of an inch in width. As will be seen later, during assembly of the novel carton from its two components, the tab hinge line 24 is located adjacent flap hinge line 48 and having hinge line 24 in the form of a wide score allows for insertion of a fully satisfactory, i.e. strong and rigid corrugation arrangement even though two hinge lines may not be exactly aligned, a great advantage when high speed processing is involved.

Turning to FIG. 1*b*, this is very similar to FIG. 1*a* and all numbers correspond. The divider unit shown in this figure is provided with additional cuts 31 which extend from the extremities of each of cuts 28 parallel to and spaced from hinge line 24. In this unit, the residual piece of board material between cuts 31 and tab line 24 form definite "tongue" members 33: in the unit of FIG. 1*a* the corresponding tongue portions 29 and 29' are very short in length.

Turning to FIG. 2, this illustrates the glueing pattern for the corrugated divider unit. Effectively the whole of one side of each of end panels 10 and 12 are covered by glue — the underneath (denoted by single line shading) of panel 10 and the top (denoted by grid-style shading) of panel 12. It will be noted that no adhesive is applied to the center panel 14 or to the tab 24. It is extremely important that adhesive is not applied to tab 24, especially the longitudinally outermost portions thereof which overlie the interior surface of sidewall 34, either positively or by seepage from the adhesive applied to portion 20 of panel 10.

Figure 3:
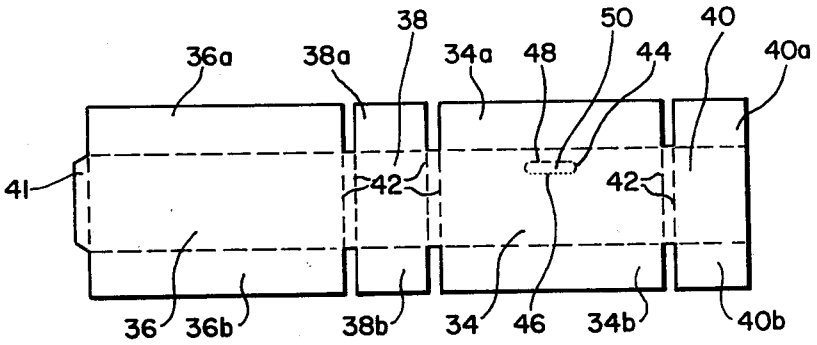
FIG. 3 is a plan view of a flattened carton shell which in combination with the divider unit forms the carton of the present invention.

Turning to FIG. 3, this illustrates a non-assembled carton shell which in combination with the divider unit of FIG. 1 constitutes the carton of the present invention. The carton shell is formed as a onepiece blank and comprises two sidewalls 34 and 36 and two endwall panels 38 and 40, the said panels being joined in an end-to-end relationship along fold or score hinge lines 42. Each of said panels is also provided with bottom and top flaps 36*a* and 36*b*; 38*a* and 38*b*; 34*a* and 34*b*; and 40*a* and 40*b* respectively, each joined to their respective panels via a score hinge line represented by a dotted line. Sidewall panel 36 is also provided with a tab 41 along its free outermost longitudinal edge. Sidewall 34 in an upper central region thereof is provided with a potential hand hole by causing performations to be made as indicated by dotted line 46 and a score hinge line as indicated by 48, lines 46 and 48 combining to define the shape of the hand hole and the shape of the flap 50 which closes same. It is pointed out that flap 50 is not detachable from sidewall 34 but is retained by hinge 48 located on the uppermost boundary of hand hole 44.

Tab 41 is provided with a layer of adhesive on the underside as shown in the drawing and thus when the blank shown in FIG. 3 is assembled the tab 41 comes in contact and becomes affixed to the inside surface of endwall 40.

Turning to FIG. 4, this illustrates an assembled carton of the present invention having the divider unit of FIG. 1*b* located in position inside the assembled carton shell. Points of note are that elongate end panel member 20 extends substantially the full length of carton wall 34 and from the uppermost edge thereof down to just beyond the hand hole 44. Tab 26 extends across the full length of hand hole 44 and a short distance, approximately half of the width of the hand hole, on either side thereof. Moreover, tab 26 has a width equal to half the width of flap 50 and therefore overlies half of the latter since hinge lines 24 and 48 are located substantially parallel and adjacent to each other.

The whole area of end panels 10 and 12 are affixed by way of glue to the interior surface of their associated carton sidewalls 34 and 36, the center panel 14 then extending laterally across the carton and parallel to each carton endwall 38 and 40.

It will be appreciated that when the carton is formed flap 50 is still an integral part of sidewall 34 and tab 26 remains in the same plane as endwall panel 10.

Figure 5:
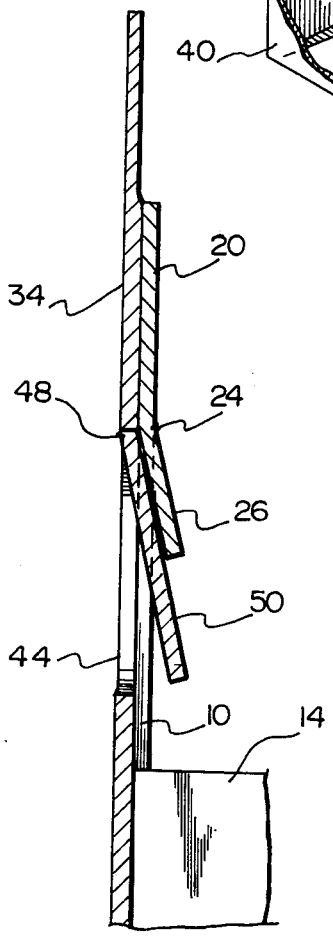
FIG. 5 is a partial section along the line X—X in FIG. 3, but wherein the hinged tab and flap are in a partially displaced condition.

Turning to FIG. 5, this illustrates the position wherein tab 26 and flap 50 are in an intermediately, partially displaced or instruck condition brought about by exerting hand pressure against the exterior surface of flap 50. This results in perforations 46 breaking and allowing the flap to pivot around hinge line 48. In doing so tab 26 is necessarily pivoted around the double score hinge line 24, the flap and tab thereby forming a double reinforcing wall and, in combination with the adjacent sidewall/panel double wall, a corrugation.

It can be seen that when the hand is inserted through hand hole 44 there is in fact a four-fold thickness of corrugated material and more importantly, the whole weight of the carton is supported along the corrugation base or ridge formed by hinge line 48 and the full length of extended hinge line 24. This ability to spread the load over a larger area of the carton is an important feature of the present invention since this drastically reduces the tendency of the material immediately above the hand hole to rip since the force applied to each specific small area of material in that region is greatly reduced.

Figure 6:
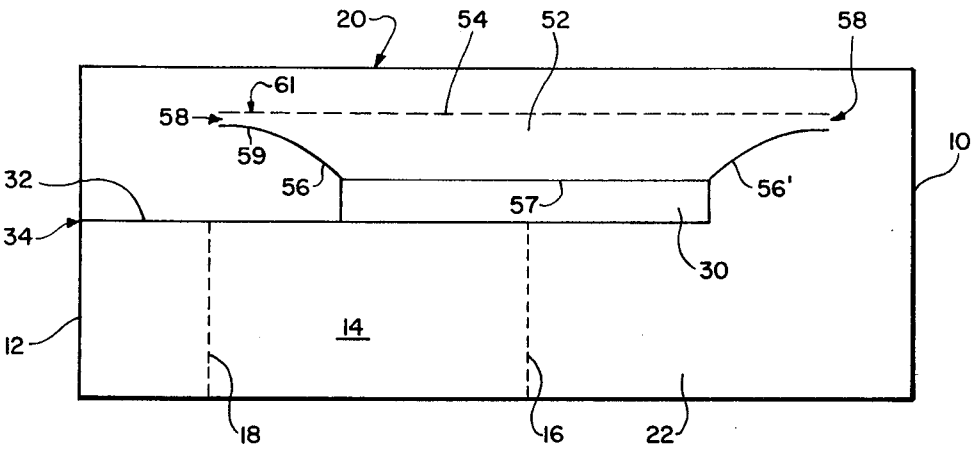
FIG. 6 is a plan view of a further article divider unit which is a preferred alternative to the unit illustrated in FIG. 1.

A divider unit which is a preferred alternative to the one shown in FIG. 1 is illustrated in FIG. 6. Portions of the divider unit shown in FIG. 6 which are identical to those depicted in FIG. 1 have been numbered correspondingly. From FIG. 6, it is seen that tab 52 is affixed to the lower edge of the central portion of member 20 by means of hinge line 54 which may be multiple score if desired. It is seen further that the sides 56 and 56' of the tab 52 are substantially concave, curvilinear, such that the portions of said ends 56 and 56' proximal to hinge line 54 are approximately parallel to and coextensive with said line 54, thereby leaving a small section or tongue 58 of the tab 52 separating the end 56 from hinge line 54.

Figure 7:
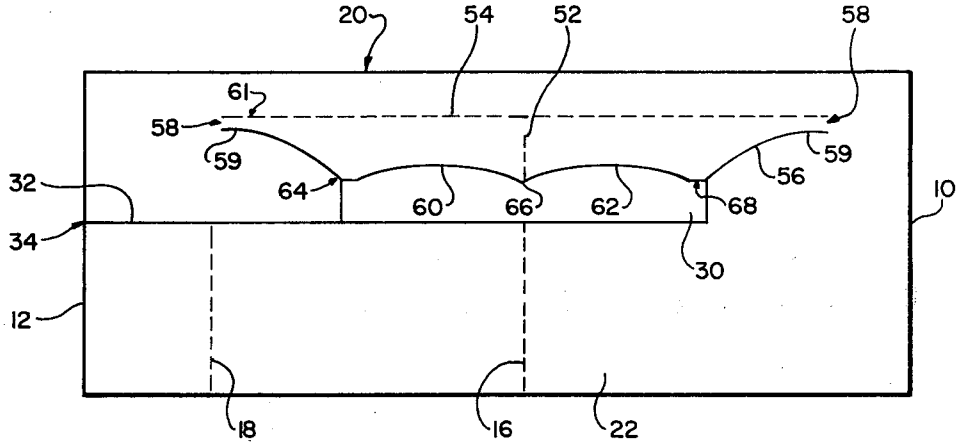
FIG. 7 is a plan view of a modified version of the divider unit shown in FIG. 6.
Figure 8:
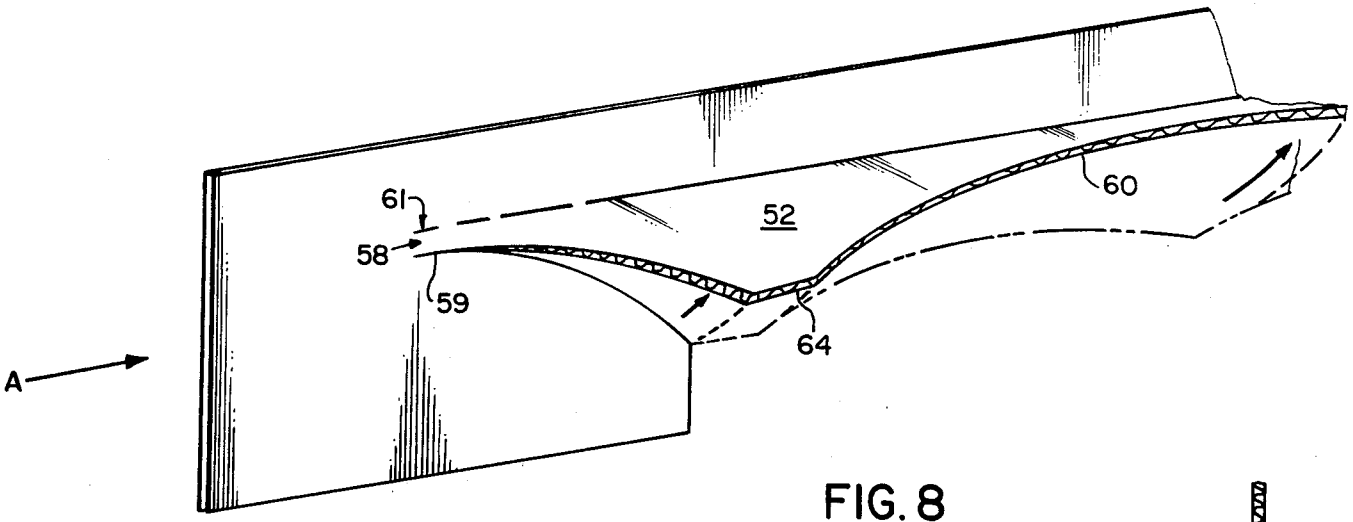
FIG. 8 is a part perspective view of the modified divider unit shown in FIG. 7, the mode of distortion of tab 52 being shown in detail.
Figure 9:
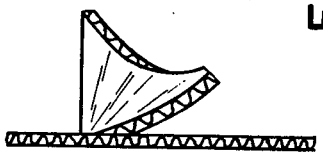
FIG. 9 is a part side elevation of the divider of FIG. 8 in the direction of the arrow.

Turning to FIGS. 7, 8 and 9, these illustrate a further modification of the divider unit of FIG. 6. Again, parts common to the dividers of FIG. 6 and 7 have been given the same numbers and it is believed that specific explanation thereof is therefore unnecessary. The major difference is the modification to shorter edge 57: reference to FIG. 7 et seq. shows that straight edge 57 of FIG. 6 is modified to comprise two convex portions 60 and 62, defined by end protrusion 64, central protrusion 66 and second end protrusion 68. The divider units illustrated per se in FIG. 6 and 7 et seq. are located in their associated carton shell in the same manner and by the same method as described with reference to FIG. 4 for the divider unit shown in FIG. 1*b*. It is therefore felt that specific illustration of cartons containing the divider units of FIG. 6 and 7 et seq. is not necessary.

The divider units of FIG. 6 and 7 et seq. function in the same manner and as follows:

In use, the fact that the portion of side 56 proximal to hinge line 54, namely 59 is approximately parallel thereto, serves to further minimize the potential tearing of the carton in the aforementioned area where the end 56 is nearest line 54, since no initiation point for such potential tearing is provided. That is, as the tab 52 is folded upwards, the curvature of side 56 serves to enhance the re-direction of the force of the load laterally. Furthermore, the small section or tongue 58 of tab 52 provides, on bending the tab 52 upwards, a more pronounced, rigid and stronger ridge forming the corrugation base to the hand when the loaded carton is being transported manually. As stated hereinbefore, it is the ridge which allows the load to be carried by substantially the full wall.

The manner in which the tab deforms so as not to provide a ready point for tear initiation is shown in detail in FIGS. 8 and 9, these figures actually showing the most preferred form of divider unit. It can be seen that the cuts 59 forming the sides 56 and 56' are, therefore, substantially parallel to the associated hinge line 54, i.e. their is no vertically oriented cut or break at which a tear could commence. Also, although the rotational curvature of the tab does affect the tongue 58, the full twist or curve is not transmitted to the base 61 thereof and hence there is a greatly reduced force, and hence tendency, of the material in the tongue portion immediately above cut 59 to tear and peel outwards (as one looks at these figures). Moreover, reference to FIG. 8 clearly shows that the presence of curve 60 (and also 62) results in even less of the tab twist deformation being transmitted to the tongue whilst still providing the required corrugation in the central portion of the tab. In this instance therefore there is even less tendency for tearing to occur. The formation of the carrying corrugation and the manner in which the tab and flap co-act greatly reduce the tendency of the latter to tear. The embodiment shown in FIG. 7 et seq. has the further advantage that it is much simpler and convenient for the carrier to instrike the tab/flap combination since the tab will not be obstructed by the bottles, these being accommodated by the curves 60 and 62 as the tab rotates under hand pressure.

As mentioned previously, the glueing pattern utilized in assembling the carton of the present invention is very critical in the region of hinge lines 48 or 50. If, inadvertently, glue becomes located, for example, between flap 50 and the interior of sidewall 34 obviously these members will adhere together. If this happens, when pressure is applied to the exterior of flap 50, in all probability tab 26 will not hinge around double score hinge line 24 but will rip laterally adjacent the lateral extremity of flap 50 thereby having a much shorter length of hinge line 24 available to carry the load.

Regarding the assembling of the carton, and in particular, the locating of the divider unit end panel 10 against sidewall 34, exact coincidence of say hinge line 24 with hinge line 48 is not required, especially in cases wherein hinge line 24 is comprised of a double or more scoring. In addition, since elongate portion 20 of end panel 10 reinforces sidewall 34 along a major portion thereof usually at least the middle two-thirds and, as shown specifically in FIG. 4 along substantially the whole length it is not necessary to provide reinforcement in the area immediately surrounding all of the hand hole and this allows aperture 30 to be somewhat larger than hand hole 44. This greatly facilitates locating of each divider unit on an associated carton shell at high speed since the allowable margin of error or tolerance involved while still obtaining a fully satisfactory carton is much greater.

Also, the rigidity and width of the ledge or platform presented to the hand by the double thickness of flap and tab makes carrying of the carton, especially when full, much more convenient and easy.

The present invention therefore provides a carton which can be made conveniently and at high speed using existing machinery and which is extremely easy and convenient to use with a greatly reduced tendency to tear. Opposing sidewalls are "tied together" and hence prevents bowing of the endwall carrying the hand hole, thus preventing loss of rigidity and strength in the corrugation.

We claim:

1. A top loading rectangular carton made of foldable sheet material, said carton comprising a carton shell and an article divider unit, the shell comprising in foldably connected relationship opposed pairs of sidewall and endwall panels, the top and bottom edges of the respective wall panels being provided with top and bottom closure flaps in foldably connected relationship thereto, one sidewall panel having in an upper central region thereof a hand hole for lifting the carton, the hand hole being closable by a flap hinged to the sidewall portion bordering the upper boundary of the hand hole, the divider unit comprising two divider end panels, one secured to the interior surface of each sidewall panel and joined by a center panel extending laterally across the carton, parallel to the carton endwall panels, to tie the sidewall panelstogether, one end panel having an elongate reinforcing portion secured to and extending over a major portion of the sidewall area between a line defined by the upper edge of the carton sidewall and a line parallel thereto and including the upper boundary of the hand hole, a generally trapezium-shaped tab having a longer and upper edge and a shorter and lower edge which edges are generally parallel to each other, and two sides, said tab being hingedly affixed along the upper edge via a hinge line to the central portion of the elongate reinforcing portion, each of said sides extending from the lower tab edge to a point short of said hinge line, said tab overlapping the whole length of the hand hole flap and having a length at least one and a half times the length of the flap and a width at least one third that of the flap, such that in a carrying condition the tab and flap coact to provide a corrugation of material of double thickness for the hand.

2. The top loading rectangular carton of claim 1 wherein said tab overlaps the whole length of the hand hole flap and has a length at least twice the length of the flap and a width at least one third that of the flap, such that in a carrying condition the tab and flap coact to provide a corrugation of material of double thickness for the hand.

3. The carton of claim 1 wherein the tab has a width of from about one third to about two thirds the width of the flap.

4. The carton of claim 1 wherein the tab has a width of about half the width of the flap.

5. The carton of claim 1 wherein the hinge line joining the tab to the elongate reinforcing portion comprises a multiple score line.

6. The carton of claim 1 wherein the tab has a width of from about one third to about two thirds the width of the flap.

7. The carton of claim 1 wherein the elongate portion of the divider end panel extends over at least 70% of the length of the associated carton sidewall.

8. The carton of claim 1 wherein the elongate portion of the divider end panel extends approximately the full length of the carton sidewall.

9. The carton of claim 1 wherein the sides of the tab are substantially concave, curvilinear in form, such that the portion of said sides proximal to the hinge line joining the tab to the elongate portion is effectively a tongue section lying approximately parallel to said hinge line.

10. The carton of claim 1 wherein the sides of the tab are substantially concave, curvilinear in form, such that the portion of said sides proximal to the hinge line joining the tab to the elongate portion is effectively a tongue section lying approximately parallel to said hinge line, the tab sides terminating adjacent the ends of the associated hinge line.

11. The carton of claim 1 wherein the shorter edge of the tab comprises two concave portions of equal dimensions, the said concave portions extending from respective end points to a common central point, all three said points lying on a line parallel to the tab longer edge.

* * * * *